US007971405B2

(12) United States Patent
Hansen

(10) Patent No.: US 7,971,405 B2
(45) Date of Patent: Jul. 5, 2011

(54) DRYWALL REPAIR PATCH

(75) Inventor: Daniel R. Hansen, Los Angeles, CA (US)

(73) Assignee: The Great Wall Patch Co., Inc., Los Angeles, CA (US)

( * ) Notice: Subject to any disclaimer, the term of this patent is extended or adjusted under 35 U.S.C. 154(b) by 495 days.

(21) Appl. No.: 11/412,382

(22) Filed: Apr. 26, 2006

(65) Prior Publication Data

US 2006/0191237 A1 Aug. 31, 2006

Related U.S. Application Data

(63) Continuation-in-part of application No. 10/842,681, filed on May 10, 2004, now Pat. No. 7,380,382.

(51) Int. Cl.
*B32B 35/00* (2006.01)
*E04G 23/02* (2006.01)

(52) U.S. Cl. ..... 52/514; 52/514.5; 156/94; 428/63

(58) Field of Classification Search ..... 52/514, 52/514.5, 746.1, 741.4, 741.41; 156/94; 426/63; 428/63
See application file for complete search history.

(56) References Cited

U.S. PATENT DOCUMENTS

| | | | | |
|---|---|---|---|---|
| 3,043,298 | A | 7/1962 | Brickman et al. | |
| 3,719,545 | A * | 3/1973 | Lawler | 428/102 |
| 3,945,842 | A | 3/1976 | Green | |
| 4,135,017 | A | 1/1979 | Hoffmann, Sr. | |
| 4,353,510 | A | 10/1982 | Damke et al. | |
| 4,381,769 | A | 5/1983 | Prahl | |
| 4,568,589 | A * | 2/1986 | Briggs | 428/63 |
| 4,707,391 | A * | 11/1987 | Hoffmann, Sr. | 428/63 |
| 4,959,251 | A * | 9/1990 | Owens et al. | 428/40.6 |
| 4,984,566 | A | 1/1991 | Sekine et al. | |
| 5,075,149 | A | 12/1991 | Owens et al. | |
| 5,269,861 | A | 12/1993 | Gilbreath | |
| 5,620,768 | A * | 4/1997 | Hoffmann, Sr. | 428/77 |
| 5,640,820 | A * | 6/1997 | Wood | 52/514 |
| 6,071,833 | A | 6/2000 | D'Alisa et al. | |
| 6,231,949 | B1 * | 5/2001 | Hoffmann, Sr. | 428/139 |
| 6,607,621 | B1 * | 8/2003 | Swanson | 156/94 |
| 6,627,292 | B1 * | 9/2003 | Hoffmann, Sr. | 428/139 |
| 6,852,408 | B2 | 2/2005 | Hansen et al. | |
| 2003/0181114 | A1 | 9/2003 | Newton et al. | |

FOREIGN PATENT DOCUMENTS

| | | |
|---|---|---|
| CA | 1300861 B | 5/1992 |

OTHER PUBLICATIONS

"Benefits with Lafarge Prestia Bandage plasters"; http://www.lafargeprestia.com/body_surgical_bandage.html, 2 pages.
"Alban Plaster of Paris Bandage-Casting Material"; http://www.albanltd.com/products.html, 2 pages.
DAP Wall Repair Patch Product Cover, 2 pages (no date).

(Continued)

*Primary Examiner* — Robert J Canfield
*Assistant Examiner* — Christine T Cajilig
(74) *Attorney, Agent, or Firm* — Howard Leslie Hoffenberg; Michael N. Cohen

(57) ABSTRACT

A drywall repair patch is disclosed. It includes a coated sheet attached to an adhesively coated porous substrate, which includes a porous sheet and a layer of dry, water-hardenable cement product carried on at least one side of said porous sheet. The repair patch is free of any rigid supporting plate.

27 Claims, 8 Drawing Sheets

OTHER PUBLICATIONS

E-Z Patch by Spray Tex product cover, 2 pages (no date).
Homax Wall Patch product cover, 2 pages (no date).
Hyde Tools Wet & Set product cover, 2 pages, 2003.
FibaTape Wall and Ceiling Repair Patch product cover, 2 pages (no date).

* cited by examiner

DRYWALL REPAIR PATCH

CROSS-REFERENCES TO RELATED APPLICATIONS

This application is a continuation-in-part application of U.S. patent application Ser. No. 10/842,681, filed on May 10, 2004, which issued as U.S. Pat. No. 7,380,382 on Jun. 3, 2008, and is hereby incorporated by reference in its entirety for all purposes.

BACKGROUND OF THE INVENTION

It is common in the construction trade to have to create channels and access holes in drywall to insert data lines, run electrical wiring and to install pipes for plumbing. Repair patches are commercially available for repairing holes, or other defects, so that the holes or defects may be completely covered without a trace of its presence, after a plastering compound such as joint compound has been applied. However, there is no presently available system to efficiently and adequately repair the typical cut channels, which are generally at least 3 to 5 inches wide that run from a few feet to any length, that commonly need to be created by electricians, plumbers and others.

The current, most popular drywall patch has a fiberglass mesh material and a metal plate. The self adhesive mesh holds the metal drywall patch in position during repair, permitting a cement product such as quickset plaster (or joint compound) to be applied over it.

The metal plate provides an improvement over earlier patch designs, which did not have such a metal plate, providing strength and structure to the patch while plaster is being applied.

However, the drywall patch that carries the metal plate has certain disadvantages. Obviously, it is not flexible, and cannot be sold in a roll, where shaped pieces can be cut out and used, for example, for the covering of channels that have been cut in drywall, using relatively long and narrow patches which may be especially cut for the job. A patch with a metal plate is generally of fixed shape, and is difficult to cut.

Another problem with the above patch which carries a metal plate is that the metal plate may pull away from the wall as the first application of plaster or joint compound is applied to cover and hide it, for finishing of the wall. This creates a raised surface that has to be feathered out with more joint compound, making it very difficult for the novice to make a professional looking repair. Also, when one does cut the metal plate to shape the metal patch, it cannot be cut easily without the use of tin snips, and even then warping of the edges of the metal plate can take place where it is cut.

Also, patches including fiberglass meshing that is comprised of a greater width than is typically used for conventional drywall tape without the metal plate have been used, but they have a problem that the plaster or other topping compound which is applied to the patch on the wall can pull the patch out of position as it is applied. This problem is especially compounded when such patches are used for repairing ceilings. A metal plate reduces this problem, but does not entirely eliminate it.

In accordance with this invention, a repair patch system is provided, which may be initially flexible before being wetted to activate the layer or layers of water hardenable cement product carried on it, and which may be cut to essentially any desired shape or size for use. Also, the patch system stays in place better as additional cement product is applied to the wall, to finish the project after the patch has been applied, particularly when it is treated in accordance with the method of this invention as described below.

BRIEF SUMMARY OF THE INVENTION

In accordance with this invention, a drywall repair patch is provided, which comprises: a mesh sheet which carries a dry, pressure sensitive adhesive layer on one side thereof, and at least one layer of a dry, water hardenable cement product also carried on said mesh sheet, typically on the other side thereof, with the mesh sheet being free of any rigid supporting plate. The repair patch is at least about four inches both in length and width, unlike drywall tape used for taping drywall seams and cracks, which is typically about two inches wide, and cannot be effectively used for patching holes or channels, where substantial drywall material is missing.

The drywall repair patch of this invention carries both dry, pressure sensitive adhesive, and a water hardenable cement product layer such as a plaster and particularly a quickset plaster, of the type used in plaster bandages for medical cast forming, such as that disclosed in U.S. Pat. No. 3,945,842. The mesh sheet may comprise a fiberglass mesh, or an organic fiber mesh such as cotton fabric. Other equivalent mesh sheets or perforated sheets may also be utilized as may be appropriate. A removable paper or plastic release sheet may protect the pressure sensitive adhesive layer.

As stated, it is preferred for the cement product used in the repair patch of this invention to comprise a plaster which is a known and commercially available material used in flexible medical bandages and the like. A gypsum plaster or plaster of Paris may be used. Also, the patch of this invention may comprise part of a roll of patch material, comprising a plurality of connected repair patches, which may be separated along a line of perforation or the like if desired, or it may be a continuous material which is cut to any desired shape, permitting the cutting of long segments for the patching of cut channels in drywall. For example, the segments may have a length that is at least five times its width.

The rolled repair patch material may carry the removable liner as stated above, to keep the pressure sensitive adhesive layer from adhesively removing the attached cement product from adjacent coils of repair patch material. Furthermore, each side of the mesh sheet may carry one or more layers of the cement product used, such as the bandage plaster, with the dry, pressure sensitive contact adhesive layer being carried on the face of a plaster layer. A large variety of dry, pressure sensitive adhesives are commercially available for use with this invention, for example the dry adhesives which are currently used with respect to metal plate-carrying wall patches, such as the Homax™ brand wall patch of the Homax Company of Bellingham, Wash. One type of dry, pressure sensitive adhesive which may be used is a rubber-based adhesive. In other embodiments, a spray adhesive may be used instead of a pressure-sensitive adhesive.

Thus, a wall patch is provided which carries both a water-hardenable cement product and a dry, pressure sensitive adhesive. The dry adhesive is used to secure the system to the wall, typically by manual pressure, in a reliable manner. The cement product is moistened to harden it on cure, typically after application of the patch to the wall, while there is a retention provided to the system by the dry adhesive. As stated, the dry, pressure sensitive adhesive may be carried on a layer of cement product, or it may be carried on one surface of the mesh and to an attached layer of cement product, optionally through the apertures in the mesh, when a second layer of cement product is not used. In either case, the wall patch can be retained in position as one moistens the cement product on the patch, to cause it to set into a rigid patch, covering the hole in the drywall, which may be a cut channel, or a hole of any other shape. Then, as is conventional, additional joint compound or the like is applied to smooth out the surface around the patch, to provide a professional looking drywall repair. The term "hole" is intended to include cut channels, and not to be limited by shape.

Further in accordance with this invention, a method is provided of applying a drywall patch to a hole in the drywall, which comprises the following steps:

One applies over the hole a mesh sheet of the drywall patch, which carries a dry, pressure sensitive adhesive layer on one side thereof, to adhere the mesh sheet to surfaces around the hole and to cover the hole. One then applies water to a layer of a dry, water hardenable cement material which is carried on the mesh sheet, and typically its outer surface, to obtain water permeation. A central portion of the wet, uncured plaster layer and the mesh sheet is then pressed into the hole, to form an indentation without substantially breaking the adherence of the mesh sheet to the surfaces of the wall around the hole, so that a concave mesh sheet portion is formed in the hole. After setting of the plaster layer, one applies a second portion of water hardenable cement material, to form a smooth wall surface over the hole and drywall patch.

The forming of the concave mesh sheet portion, prior to setting of the water hardenable cement material, helps in the subsequent "feathering out" of joint compound over the patch, making the process easier. Also, the concave portion helps to position the patch and to prevent it from moving or breaking loose as added portions of joint compound (or the like) are applied, to form the final, smooth wall surface for finishing up the hole patching project. The drywall patch is preferably initially flexible, before and after wetting of the water hardenable cement material, but when it hardens, it becomes a rigid member that is resistant to moving upon the application of lateral force, especially when the concave portion is formed, as described.

As stated previously, the hole that is patched may comprise a channel that has been cut in the drywall, for example for the insertion of lines or pipes. The patch material may be easily cut to shape from a roll in which it is provided, and applied to cover the channel. Preferably, the indentation step of the above method may also be applied in this circumstance.

As before, the mesh sheet may comprise Fiberglass of a commercially available type for wall patching, or an organic fiber fabric, and the dry adhesive and water hardenable cement product may also be of types that are commercially available. Thus, holes in drywall and similar wall materials may be covered by the patch of this invention, even though the hole is elongated in the form of a channel, or is of irregular shape.

The term "drywall" is intended to also include other appropriate walls and partitions, such as plaster walls and also ceilings.

Another embodiment of the invention is directed to a drywall repair patch which comprises: an adhesive porous substrate; and a coated sheet attached to the adhesively coated porous substrate, which comprises a porous sheet and a layer of dry, water-hardenable cement product carried on at least one side of said porous sheet, said repair patch being free of any rigid supporting plate.

BRIEF DESCRIPTION OF THE DRAWINGS

In the drawings,

FIG. 10(*b*) is a side view of a drywall repair patch of the type shown in FIG. 9 as it would be mounted on over a hole in drywall.

DETAILED DESCRIPTION OF THE INVENTION

Figure 1:
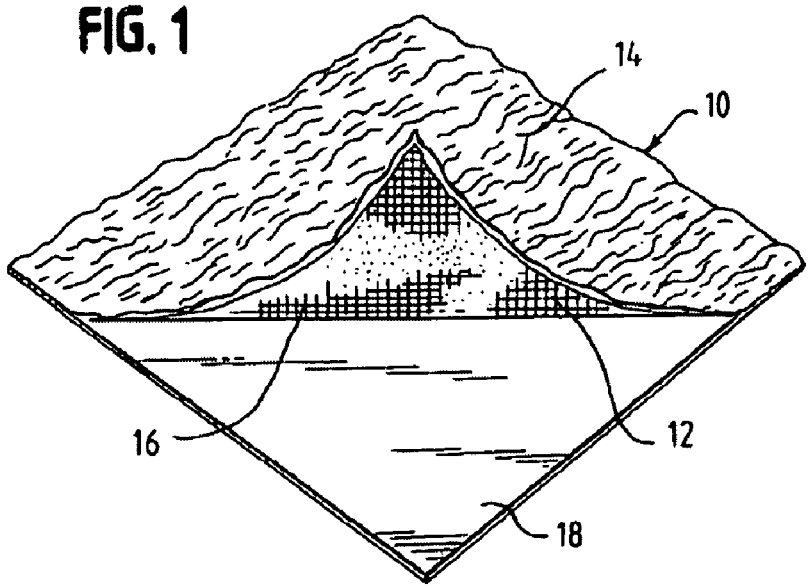
FIG. 1 is a perspective view of a square of the drywall repair patch material of this invention.

Referring to FIG. 1, a drywall repair patch is shown, cut into a twelve inch square of material. Drywall repair patch 10 comprises a mesh sheet of fiberglass similar to the type of fiberglass used in prior art drywall repair patches.

Fiberglass mesh sheet 12 carries primarily on an upper side, as shown in FIG. 1, a layer of flexible plaster 14, which may be similar to the plaster used in medical plaster bandages. On the other side 16 of mesh sheet 12, a layer of dry, pressure sensitive adhesive is provided, either placed on the crossing stands of mesh sheet 12 or as a layer over a second layer of flexible, bandage-type plaster on other side 16, which, in turn, adheres to mesh 12.

Finally, a conventional release sheet 18 is provided, adhering to the adhesive to protect the adhesive until use.

Figure 2:
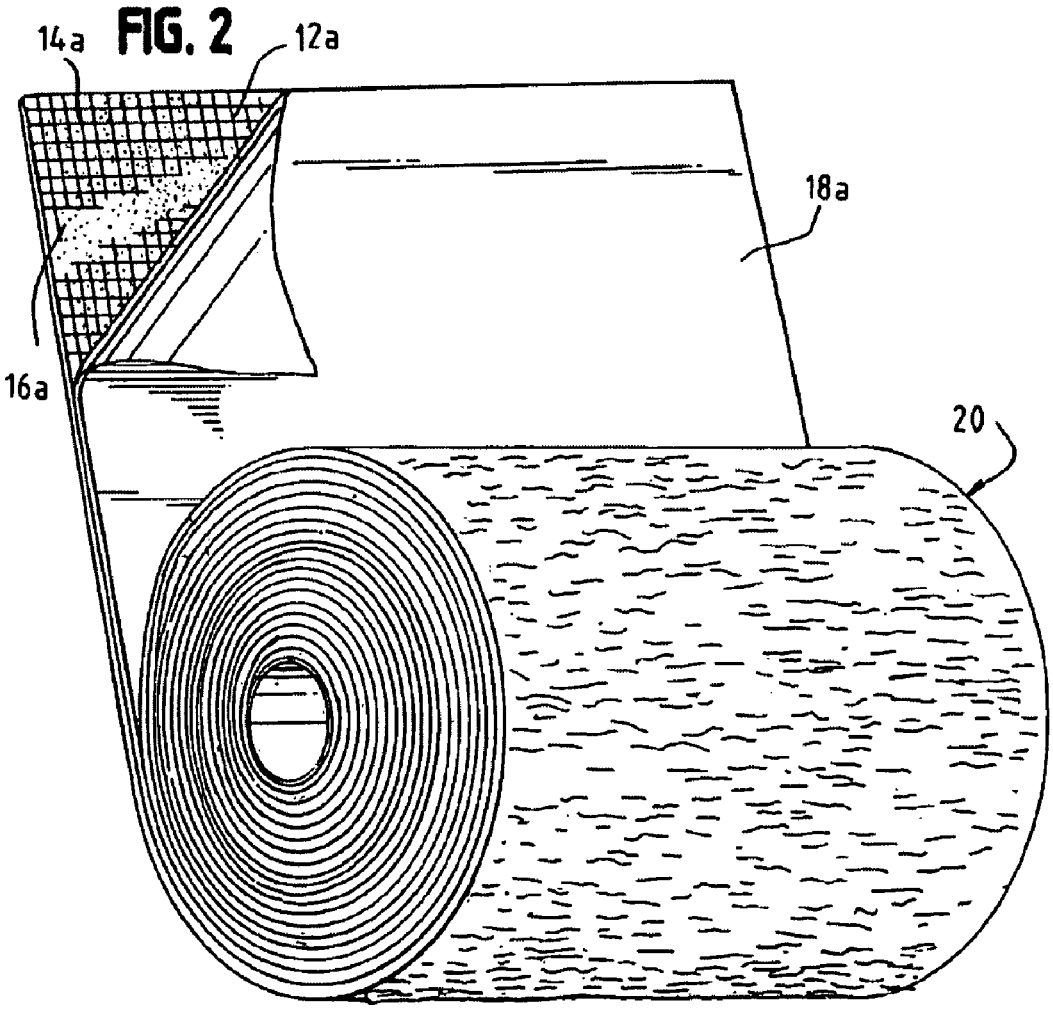
FIG. 2 is a perspective view of a roll of the drywall patch material of this invention.

Thus, as shown in FIG. 2, because of the flexibility of the uncured plaster layer or layers 14, the roll 20 of drywall repair patch material can be provided, comprising the preferably fiberglass mesh sheet 12*a*, carrying an outer layer of flexible plaster 14*a* and having a strip of release paper or plastic 18*a* overlying the dry, pressure sensitive adhesive 16*a*, with or without a second, intervening layer of water hardenable plaster between adhesive 16*a* and mesh sheet 12*a*.

The use of the repair patch of this invention is shown in FIGS. 3-7.

Figure 3:
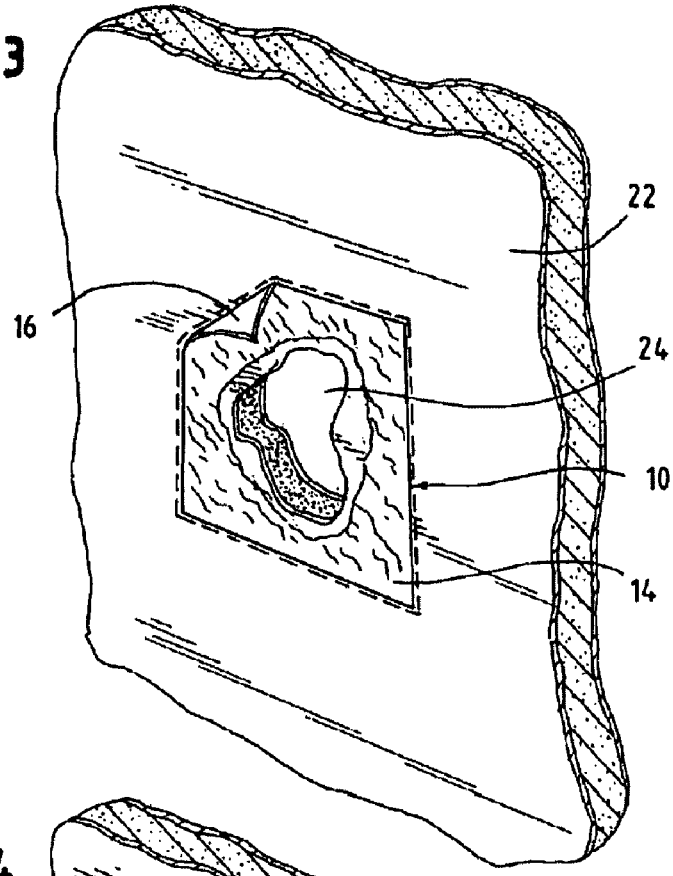
FIG. 3 is a perspective view, with portions broken away, showing the drywall patch material covering a hole in a section of drywall.

Turning to FIG. 3, a piece of vertical drywall 22 is shown having a hole 24 caused by damage, or alternatively intentionally created for access through the drywall. Patch 10 is shown being applied to overlie the hole 24 and to be attached to the drywall by dry adhesive layer 16. Backing layer 18 is of course removed prior to application of drywall patch 10. The central portion of drywall patch 10 has been removed to show the hole 24 that is being patched.

Figure 4:
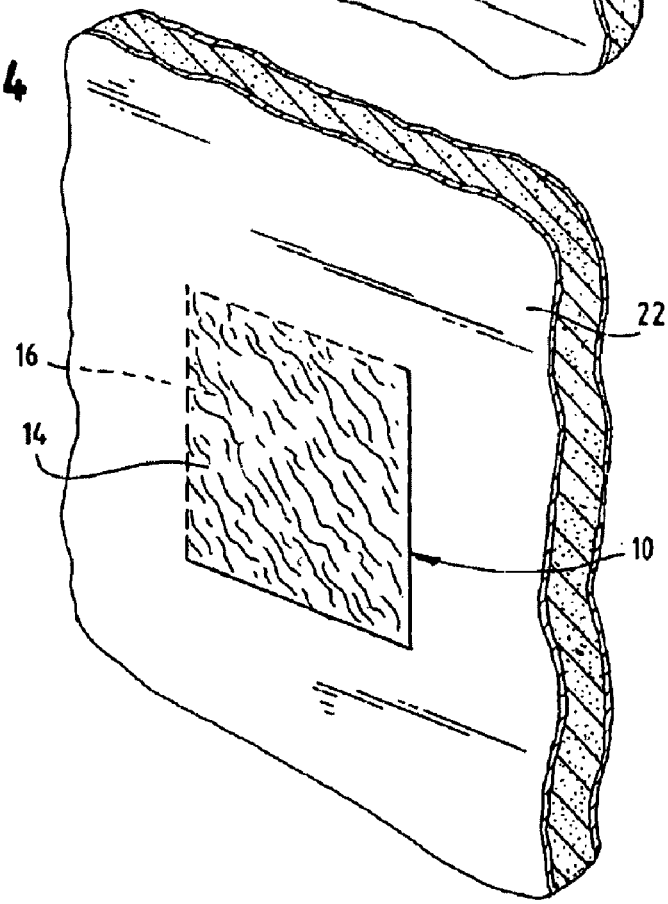
FIG. 4 is a perspective view of the drywall patch, applied as in FIG. 3, without any portion being broken away.

Turning to FIG. 4, drywall patch 10 is shown applied to drywall 22, making use of the dry adhesive layer 16, which secures drywall patch 10 to peripheral portions of the drywall around aperture 24, and with water hardenable plaster layer 14 facing outwardly.

Figure 5:
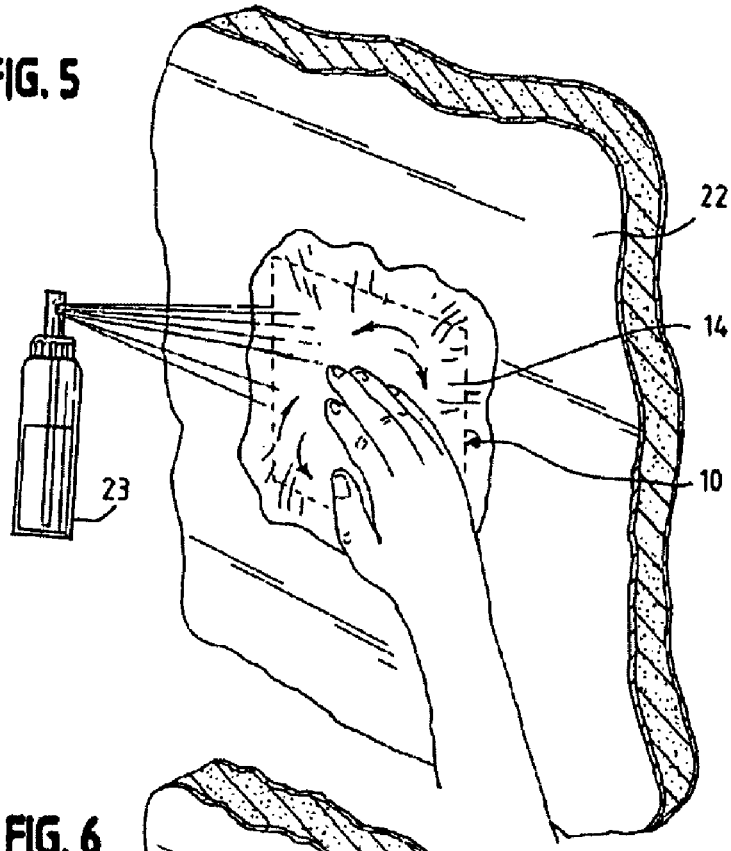
FIG. 5 shows how, in accordance with this invention, the drywall patch square of FIG. 4, after application to the wall using the dry adhesive, may have a water spray applied to activate and cure the water hardenable cement product.

Then, in FIG. 5, water is applied, typically in a spray form, to plaster layer 14 of the adhering drywall repair patch 10 on drywall 22, to moisten and soften the water hardenable plaster of layer 14, typically with gentle rubbing, spreading it outwardly a bit beyond patch 10.

Figure 6:
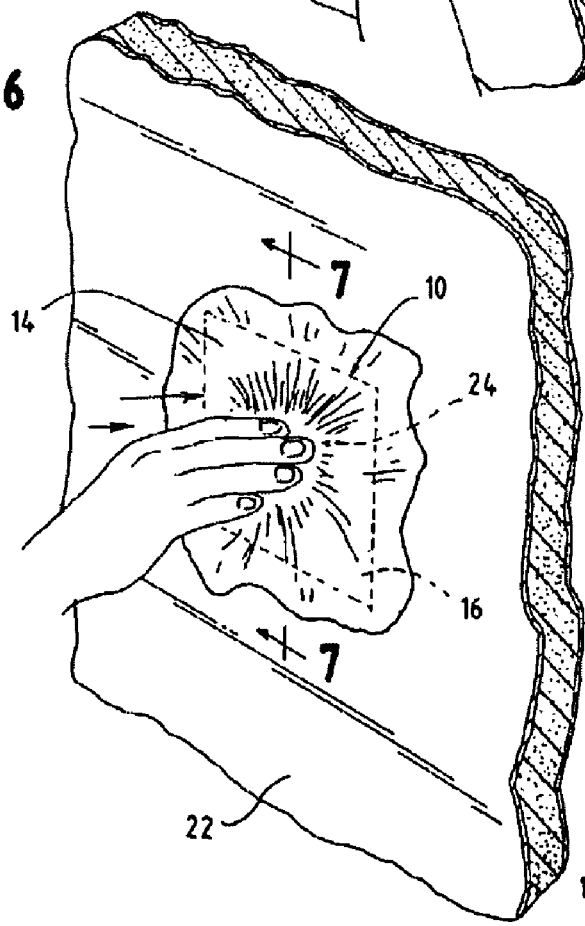
FIG. 6 is a perspective view showing how the patch, typically after treatment of FIG. 5, may be depressed in the center to form a concave indentation extending into the hole of the drywall, which indentation remains upon hardening of the cement product.
Figure 7:
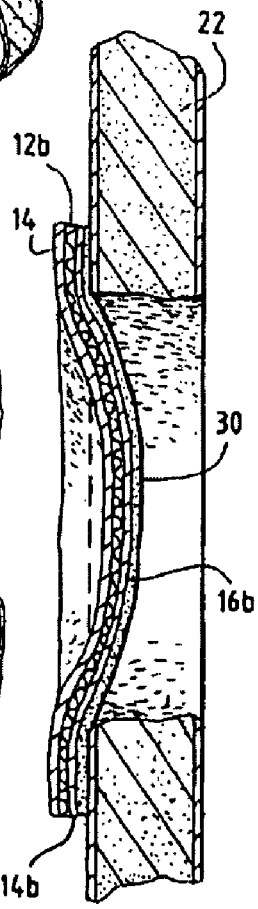
FIG. 7 is a sectional view taken along line 7-7 of FIG. 6.

Turning to FIG. 6, after the water hardenable plaster layer has been adequately hydrated by use of a water spray 23, it is preferred to manually press inwardly a central portion of drywall repair patch 10, preferably by at least about 5 mm at the deepest point, to form a concave portion or indentation 30 of the drywall patch that extends into hole 24, as particularly illustrated in FIG. 7. This is accomplished without substantially breaking the adherence of the mesh sheet 12, through adhesive layer 16, to the surfaces of drywall 22 around hole 24, by stretching of the central portion of drywall patch 10 and, as needed, some inward sliding of more peripheral portions of drywall patch 10, without breakage of the adhesive bond to the drywall.

Then, the drywall patch 10 is allowed to remain undisturbed until the hydrated plaster has set, causing dry-wall patch 10 to become rigid.

Because of the indentation 30, the installed, hardened drywall patch becomes more resistant to side forces that can cause it to separate, as a finishing layer of joint compound is applied to the wall patch in a conventional manner. This second portion of joint compound (or other water hardenable cement material) may often be more easily applied to form a smooth wall surface over the hole and the drywall patch because of indentation 30, to provide a professional looking repair. The presence of the concave recess 30 facilitates the application of a manually applied, added layer of water hardenable plaster, joint compound, or equivalent material, to form a smooth, essentially invisible wall surface over the hole and patch, using otherwise conventional plaster application techniques.

It should be noted that in FIG. 7, drywall patch 10 has been modified from its configuration in FIG. 1, to have a water hardenable cement material layer 14, 14*b* on each side of the mesh layer, and adhesive layer 16*b* is carried on layer 14*b*. This modified design may be used where additional amounts of plaster carried by the mesh sheet may be desired. However, the use of either design of drywall patch may be accomplished in the manner described above.

Figure 8:
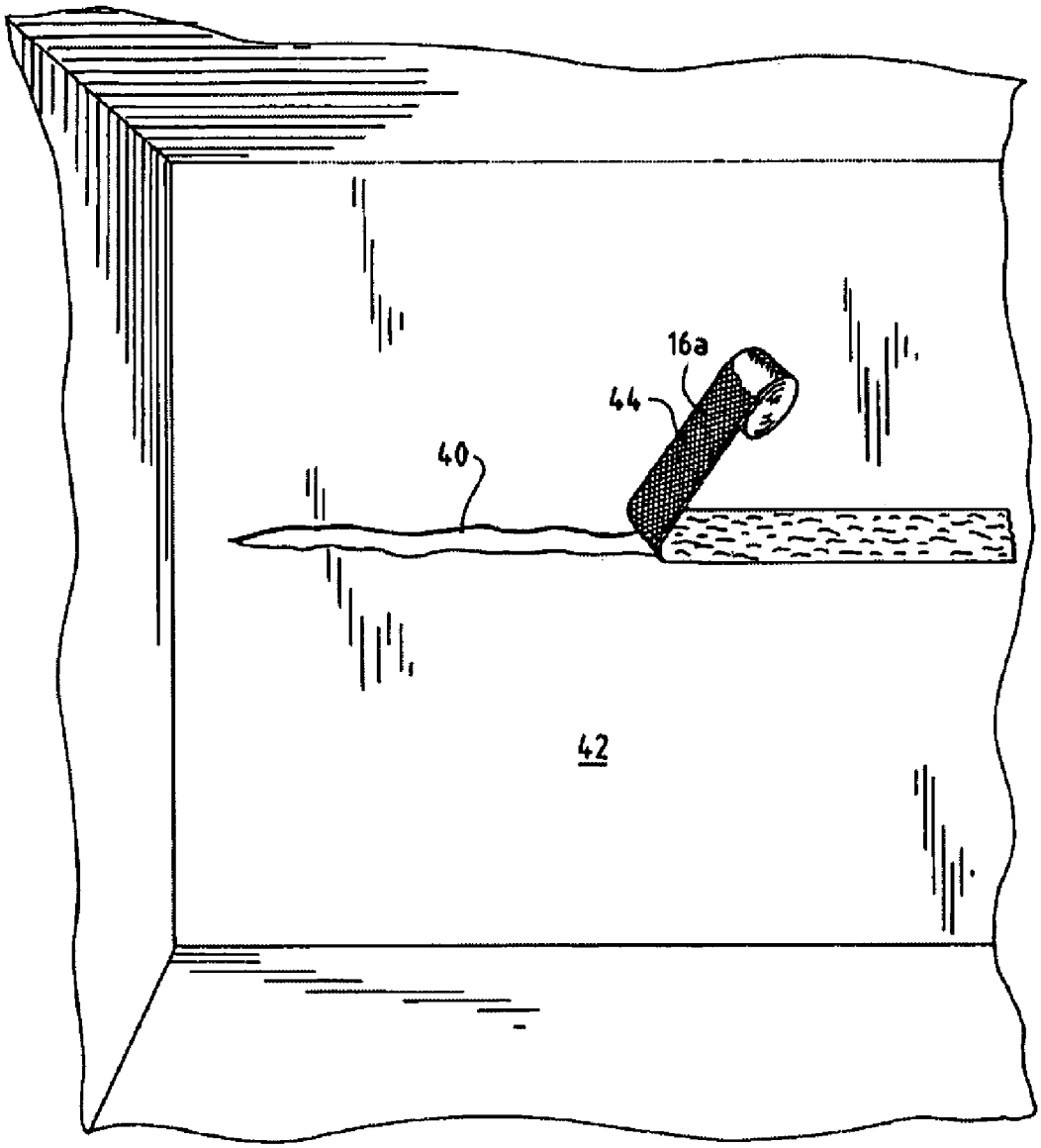
FIG. 8 is a perspective view of a channel in drywall being covered with a 6 inch wide strip of the patch of this invention.

Also, differently shaped segments of drywall patch material may be cut from the roll 20 of drywall patch material. For example, as in FIG. 8, a long channel 40 may have been cut through drywall 42 for the installation of a pipe or electric line. In that circumstance, the drywall patch 44, made as in FIG. 2, may comprise a long strip of material, which may be cut from the roll of FIG. 2, and applied over the channel 40, with the adhesive layer 16*a* adhering the drywall patch to the drywall material 42 that adjoins the cut channel. Then, the drywall patch may be hydrated as before, to wet plaster layer 14*a* and, preferably, an indented groove portion in the central part of the drywall patch strip may be pressed into channel 40. The drywall patch strip is then allowed to harden, prior to further application of joint compound or the like for finishing of the wall patching, thus achieving the advantages of this invention.

By this invention, a preferably flexible drywall patch can be applied to cover a hole in drywall while the patch is still in dry condition, making use of a dry, pressure sensitive adhesive layer 16, 16*a*, 16*b*. Then, a layer of water hardenable cement material, carried by the drywall patch mesh 12, 12*a*, 12*b*, may be hydrated and, preferably, indented into the hole being covered, to provide a patch, after it hardens, which stays in place more readily than the drywall patch systems of the prior art, permitting easier, subsequent application of wet joint compound or plaster over the patch and hole, to finish the project in a professional quality manner.

As another embodiment, a medical plaster bandage, sold by Johnson and Johnson for cast forming, was coated on one face with a contact adhesive, and adhered to drywall in a manner covering a hole in the drywall. Then the bandage, adhering to the drywall, was hydrated with a water spray, and a central portion thereof was pressed inwardly to create a concave portion of the bandage extending into the hole. After hardening of the plaster bandage, joint compound was easily applied, to hide the presence of the bandage patch.

Figure 9:
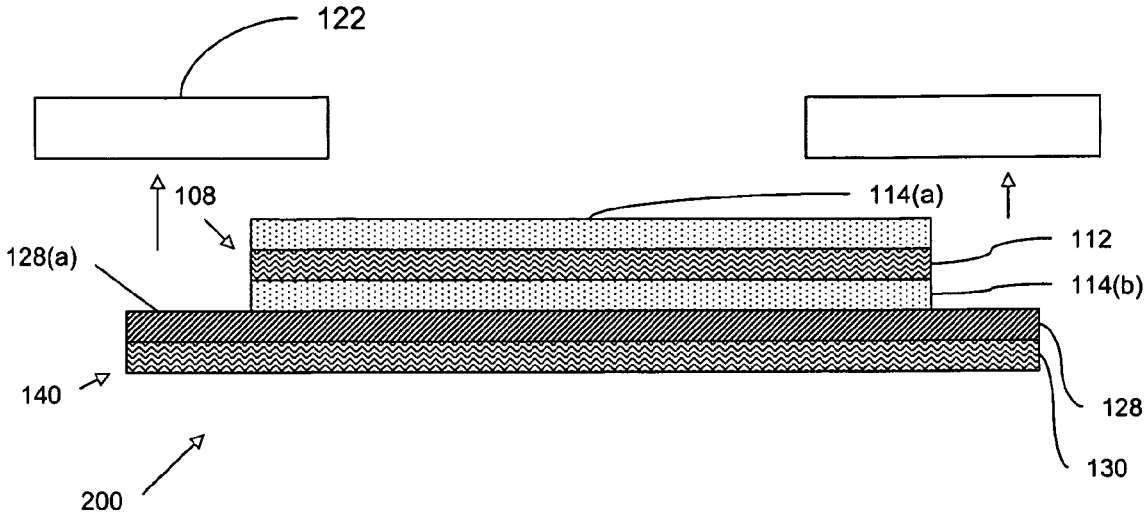
FIG. 9 is a side, cross-sectional view of a drywall repair patch according to an embodiment of the invention. In this embodiment, the drywall repair patch includes a supporting, adhesively coated mesh substrate and a mesh coated with one or more layers of plaster material.
Figure 10A:
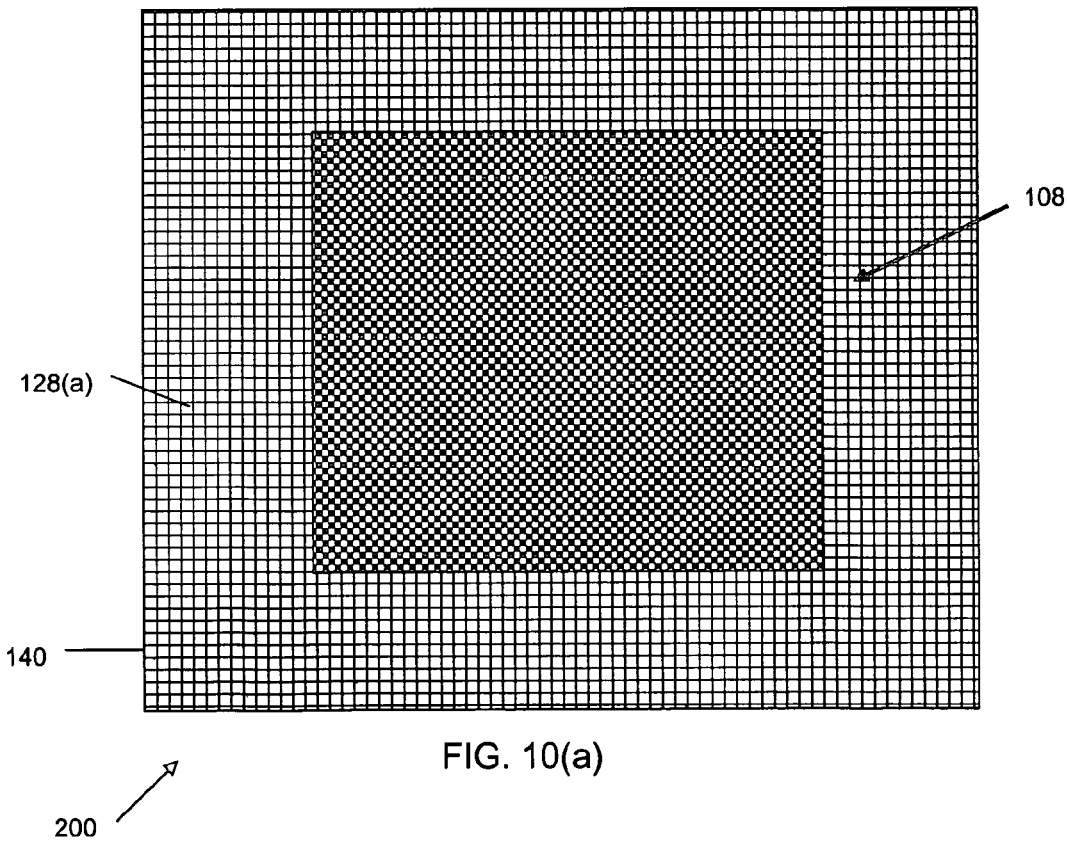
FIG. 10(*a*) is a top plan view of a drywall repair patch of the type shown in FIG. 9.
Figure 9A:
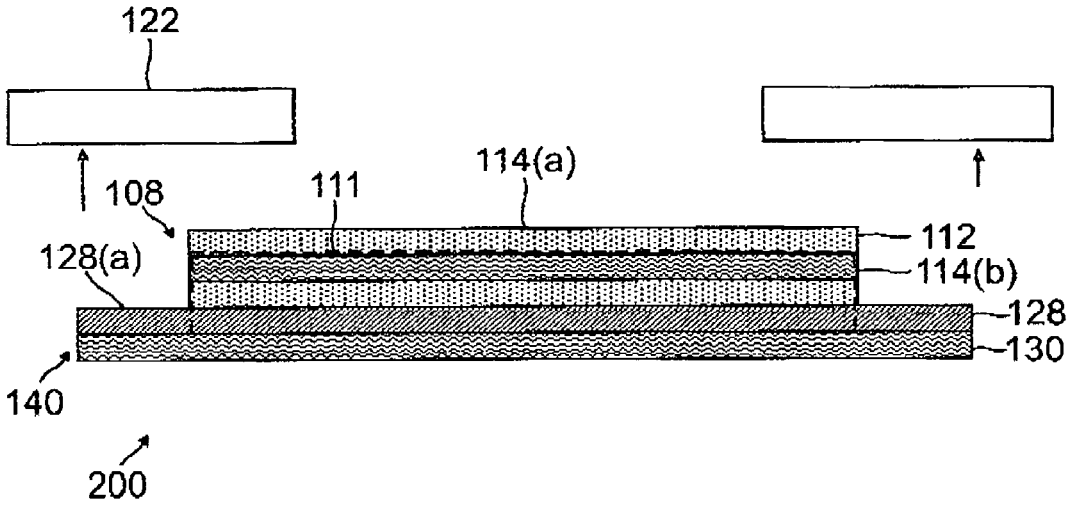
Figure 10B:
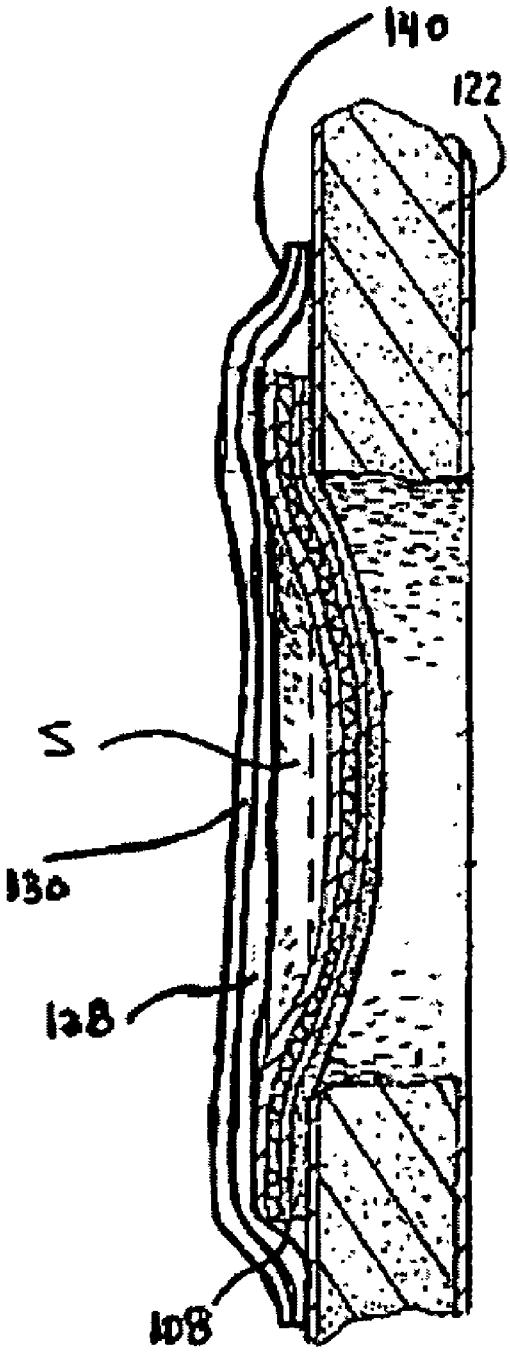

FIGS. 9 and 10(*a*) show another drywall repair patch embodiment of the invention. Referring to FIG. 9, the drywall repair patch 200 includes an adhesive porous substrate 140 and a coated sheet 108 attached to the adhesive porous substrate 140.

The adhesive porous substrate 140 may comprise any suitable structure and may comprise any suitable material. In a preferred embodiment, as shown in FIG. 9, the adhesive porous substrate 140 may include distinct materials including a mesh sheet 130 and an adhesive layer 128 on the mesh sheet 130. In FIG. 9, the adhesive layer 128 is shown as being on one side of the mesh sheet 130, while in other embodiments, an adhesive layer could be on both sides of the mesh sheet 130 as well as within the openings of the mesh sheet 130. In yet other embodiments, the adhesive porous substrate 140 may comprise fibers or another porous material that is inherently adhesive.

The coated sheet 108 may include a porous substrate 112, which may be in the form of a mesh sheet. One or more layers of a water-hardenable cement product 114(*a*), 114(*b*) such as plaster may be present on the porous substrate 112 and within the interstices of the porous substrate 112. The coated sheet 108 may be of similar construction as the repair patch described with respect to FIG. 1.

As shown in FIG. 10(*a*), the outer edges of the coated sheet 108 may lie within the outer edges of the adhesive porous substrate 140. Thus, an exposed region 128(*a*) of the adhesive layer 128 and the adhesive porous substrate 140 may surround (completely or partially) the outer edges of the coated sheet 108. As shown in FIG. 9, this exposed region 128(*a*) may adhere the repair patch 200 to a wall 122 so that the repair patch 200 covers a hole in the wall 122. As in prior embodiments, a release sheet (not shown) may be attached to the exposed region 128(*a*) and may also cover layer 114(*a*) so that the adhesive properties of the exposed adhesive layer 128 are preserved prior to use. Also, as in prior embodiments, the patch 200 may form a portion of a roll of material. In this case, both the coated sheet 108 and the adhesive porous substrate 140 may be in the form of longitudinal strips.

The embodiment shown in FIG. 9 may be formed using any suitable method. For example, the porous sheet 108 may be first formed by impregnating and coating the porous substrate 112 with the water-hardenable cement product layers 114(*a*), 114(*b*). Before or after the porous sheet 108 is formed, the adhesive porous substrate 140 may be formed. For example, adhesive porous substrate 140 may include a mesh sheet 130, which may be coated on one or both sides with an adhesive layer 128. Once the porous sheet 108 and the adhesive porous substrate 140 are formed, they can be attached together using an adhesive, stitch, or any other suitable attachment mechanism.

As apparent from FIGS. 9 and 10(*a*), preferred embodiments of the invention may include a multiple layer system, wherein a coated sheet includes a plaster material and a second adhesive porous substrate includes a fiberglass mesh. The two layers are sandwiched together using the adhesive that is already on and impregnated with the fiberglass mesh. The bond between the coated sheet and the adhesive porous substrate may be reinforced with stitching similar to that used in the sewing of clothing. The stitching material may be made of different material such as cotton fiber or fiberglass and sewn to the outer edges of the plaster material binding it to the fiberglass. In this embodiment, adhesive may or may not be applied to the cement product layer 114(*a*). The initial positioning or adherence of the repair patch 200 to the area of the wall 122 being repaired, can be performed using only the exposed adhesive region 128(*a*) of the adhesive porous substrate 140.

The same general process as described with respect to FIGS. 5 and 6 above, may be used with the repair patch 200 shown in FIGS. 9 and 10(*a*), and the above-description is herein incorporated by reference.

Illustratively, after attaching the repair patch 200 to the wall 122 shown in FIG. 9 and as described above, a second step, or bonding step, may be performed. The bonding step includes moistening the plaster material with water and rubbing it (e.g., by hand) until it has a somewhat milky appearance. This will activate and help to mix the plaster and once it hardens, it will create a strong bond with the wall.

Then, an indentation is created as described above. The user waits for a minute or two until the plaster material begins to become rigid and will use his fingers to push the plaster material inside the wall allowing the patch to hold its shape until it is fully cured or hardened. As described above, outer coats of cement material (e.g., plaster) may then be applied to the adhered repair patch.

Advantageously, the indentation will make it easier for a novice to create a flush, professional looking repair. Also, the embodiments shown in FIGS. 9 and 10(*a*) also make the repair patch stronger than other similar patches with only one layer. Referring to FIG. 10(*b*), if one looks at a hardened patch after it is used to cover a hole in a wall 122, one will see a separation or air space S between the hardened plaster material in the porous sheet 108 and the outer fiberglass meshing 130 in the adhesive porous substrate 140 located over the area of the indentation portion of the patch. This allows for a complete penetration into the fiberglass meshing material by the first coat of plaster or gypsum compound that is normally applied by using a standard putty knife. The penetration of the cement product into the fiberglass meshing (plaster or gypsum compound squeezed through the holes or gaps in the fiberglass meshing) is desirable for additional strength. Stated differently, if one pushes one's finger on a fiberglass meshing of an adhered patch, it has resiliency and bounces back to the same position once the finger is removed, thus leaving a space between the hardened plaster material and the fiberglass meshing. The hardened plaster material essentially acts as a rigid backing that will support and hold in place, the fiberglass meshing and the first coat of the plaster or gypsum compound until it hardens. Fiberglass alone is not strong enough to hold the plaster compound as it can sometimes be too heavy. Thus, the embodiments shown in FIGS. 9 and 10 may be considered "multidimensional devices".

Figure 11:
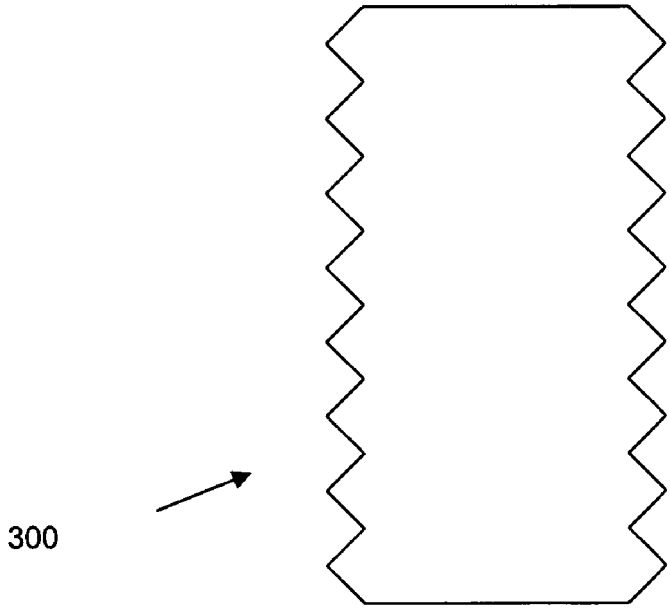
FIG. 11 shows a top plan view of a drywall repair patch with zig-zag edges.

FIG. 11 shows a repair patch 300 including zig-zag edges. Any component of any of the above-described patches may include this feature. For example, the adhesive porous substrate 140 and/or the porous sheet 108 could include this feature. A zigzag finish, instead of a straight cut along the edges, will create greater surface area for the plaster material to bond to the wall. It will also create more surface area for the first coating of plaster or gypsum compound to bond to, along with the wall. It will also help to camouflage the edges from being easily recognizable once the patch is finished and ready to paint.

Figure 12:
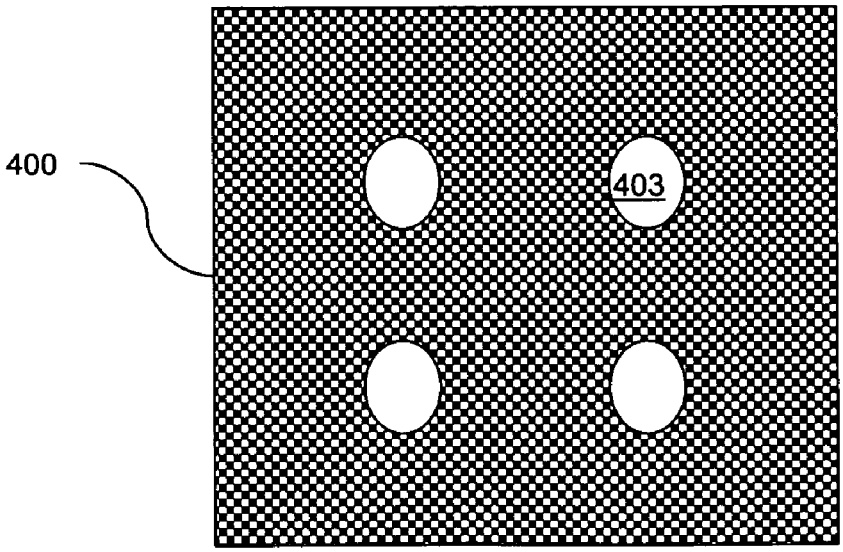
FIG. 12 shows a top plan view of a drywall repair patch with large apertures in it.

FIG. 12 shows a repair patch 400 including a number of apertures 403, which are larger than the pores in the above-described porous sheet 108 and/or adhesive porous substrate 140. The pores in the porous sheet 108 and/or adhesive porous substrate 140 may not be large enough to allow plaster or gypsum compound to "squeeze" through. Thus, it is possible to include larger apertures 403 so that plaster material or other cement product can pass through the larger holes in addition to the smaller ones that already exist. The apertures 403 can be about 1/16"-1/8" in diameter. This will increase the overall strength of the repair patch.

The repair patch embodiments of the invention also conform to the contours of a wall being repaired better than commercially available metal patches (especially when walls have a knockdown or an orange peel textured finish).

The above has been offered for illustrative purposes only, and is not intended to limit the scope of the invention of this application, which is as defined in the claims below. For example, although dry, pressure sensitive adhesives are described in detail above, it is possible to use other types or forms of adhesives including spray adhesives. For instance, it is possible to use a spray adhesive as an attachment means to attach a coated sheet that is devoid of adhesive, to a wall. In such embodiments, the user would simply spray adhesive on the wall that borders around the hole that needs repair. The coated sheet could be secured to the wall by pushing it against the adhesive on the wall. This will secure it and hold it in place on the wall until the patch is moistened with water as described above.

What is claimed is:

1. A drywall repair patch for a hole in a drywall surface comprising:

a first porous, flexible and stretchable substrate having adhesive properties which has the capability of making an adhesive adherence to a drywall surface about a hole and a second porous, flexible and stretchable substrate coated with a layer of dry, water hardenable cement product on at least one side of the second porous, flexible and stretchable substrate, where the repair patch is free of any rigid support plate and has the property that a portion positioned opposite a hole that is manually pressed inward up to about 5 millimeters can stretch such that there is no substantial breaking of an adhesive adherence of the first porous, flexible and stretchable substrate to a drywall surface.

2. The repair patch of claim 1, wherein the first porous, flexible and stretchable substrate is a mesh sheet comprising a material selected from the group consisting of plastic material, fiberglass, and cotton.

3. The repair patch of claim 1 in which said cement product comprise a bandage plaster.

4. The repair patch of claim 1 wherein the first porous, flexible and stretchable substrate has zig-zig edges.

5. The repair patch of claim 1 wherein the first porous, flexible and stretchable substrate comprises a plastic mesh and an adhesive layer on the plastic mesh, and wherein the repair patch has a size of at least four inches in length and in width.

6. A roll of patch material comprising the drywall repair patch of claim 1.

7. A drywall repair patch device comprising:

the repair patch of claim 1; and a release sheet covering at least a portion of the first porous and flexible substrate.

8. The repair patch of claim 1 wherein the dry, water hardenable cement product is applied to both sides of the second porous, flexible and stretchable substrate prior to applying the repair patch to a surface.

9. The repair patch of claim 1 wherein the first porous, flexible and stretchable substrate has an area greater than the second porous, flexible and stretchable substrate.

10. The repair patch of claim 1 wherein the second porous, flexible and stretchable substrate and the layer of dry, water hardenable cement product includes a plurality of apertures which are larger than pores in the second porous, flexible and stretchable substrate.

11. The repair patch of claim 1 wherein the first and second first porous, flexible and stretchable substrates are stitched together.

12. The repair patch of claim 1 wherein the first and second porous, flexible and stretchable substrates are stitched together with a material selected from the group consisting of cotton fiber or fiberglass.

13. A drywall repair patch for a hole in a drywall surface comprising:

a first porous, flexible and stretchable substrate having adhesive properties which has the capability of making an adhesive adherence to a drywall surface about a hole and a second porous, flexible and stretchable substrate coated with a layer of dry, water hardenable cement product on at least one side of the second porous, flexible and stretchable substrate, where the repair patch is free of any rigid support plate and has the property that a portion positioned opposite a hole that is manually pressed inward up to about 5 millimeters can stretch such that there is no substantial breaking of an adhesive adherence of the first porous, flexible and stretchable substrate to a drywall surface and wherein the first and second porous, flexible and stretchable substrates are stitched together with a material selected from a group consisting of cotton fiber or fiberglass, and the second porous, flexible and stretchable substrate and layer of dry, water hardenable cement product includes a plurality of apertures which are larger than pores in the second porous and flexible substrate.

14. The repair patch of claims 2, 3, 4, 5, 6, 7, 8, 10, 11, 12 and 13 wherein the first porous, flexible and stretchable substrate has an area greater than the second porous and flexible substrate.

15. The repair patch of claims 2, 3, 4, 5, 6, 7, 8, 9, and 10 wherein the first and second porous, flexible and stretchable substrates are stitched together with a material selected from the group consisting of cotton fiber or fiberglass.

16. The repair patch of claims 3, 4, 6, 7, 8, 9, 10, and 11, wherein the first porous, flexible and stretchable substrate is a mesh sheet comprising a material selected from the group consisting off plastic material, fiberglass, and cotton.

17. The repair patch of claims 2, 4, 5, 6, 7, 8, 9, 10, 11, 12 and 13 in which said cement product comprise a bandage plaster.

18. The repair patch of claims 2, 3, 5, 6, 7, 8, 9, 10, 11, 12 and 13 wherein the first porous and flexible substrate has zig-zig edges.

19. The repair patch of claims 2, 3, 4, 6, 7, 8, 9, 10, 11, 12 and 13 wherein the first porous, flexible and stretchable substrate comprises a plastic mesh and an adhesive layer on the plastic mesh, and wherein the repair patch has a size of at least four inches in length and in width.

20. A roll of patch material comprising the drywall repair patch of claims 2, 3, 4, 5, 7, 8, 9, 10, 11, 12 and 13.

21. A drywall repair patch for a hole in a drywall surface comprising:

a roll of patch material having a first porous, flexible and stretchable mesh sheet having pressure sensitive adhesive material which has the capability of making an adhesive adherence to a drywall surface about a hole;

a second porous, flexible and stretchable substrate coated with a layer of dry, water hardenable cement product on at least one side of the second porous and flexible mesh sheet and a release sheet covering at least a portion of the first porous and flexible mesh sheet, where a repair patch previously part of the roll is free of any rigid support plate and has the property that a portion positioned opposite a hole that is manually pressed inward up to about 5 millimeters can stretch such that there is no substantial breaking of an adhesive adherence of the pressure sensitive adhesive material to a drywall surface.

22. The repair patch of claim 21 wherein the first and second porous, flexible and stretchable substrates are stitched together with a material selected from, the group consisting of cotton fiber or fiberglass.

23. The repair patch of claim 21 wherein the first porous, flexible and stretchable substrate has an area greater than the second porous, flexible and stretchable substrate.

24. The repair patch of claim 21 in which said cement product comprise a bandage plaster.

25. The repair patch of claim 21 wherein the first porous and flexible substrate has zig-zig edges.

26. The repair patch of claim 21 wherein the first porous, flexible and stretchable substrate comprises a plastic mesh and an adhesive layer on the plastic mesh, and wherein the repair patch has a size of at least four inches in length and in width.

27. A roll of patch material comprising the drywall repair patch of claim 21.

* * * * *